US006386905B1

(12) United States Patent
Ito

(10) Patent No.: US 6,386,905 B1
(45) Date of Patent: May 14, 2002

(54) FLAT CABLE CONNECTOR

(75) Inventor: Tomonari Ito, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/678,337

(22) Filed: Oct. 3, 2000

(51) Int. Cl.[7] ..... H01R 12/24
(52) U.S. Cl. ..... 439/495; 439/493
(58) Field of Search ..... 439/495, 496, 439/260, 325, 499

(56) References Cited

U.S. PATENT DOCUMENTS

| | | | | |
|---|---|---|---|---|
| 5,015,197 A | | 5/1991 | Redmond et al. | 439/493 |
| 5,397,247 A | * | 3/1995 | Aoki et al. | 439/495 |
| 5,813,877 A | * | 9/1998 | Nakamura | 439/495 |
| 5,871,369 A | | 2/1999 | Obayashi et al. | 439/495 |
| 5,906,504 A | * | 5/1999 | Igarashi et al. | 439/495 |
| 5,938,471 A | | 8/1999 | Burgess | 439/493 |

FOREIGN PATENT DOCUMENTS

| | | |
|---|---|---|
| GB | 2325793 | 12/1998 |
| WO | WO 95/23442 | 3/1995 |

* cited by examiner

*Primary Examiner*—Tho D. Ta
(74) *Attorney, Agent, or Firm*—Banner & Witcoff, Ltd.

(57) ABSTRACT

A housing 10 includes a board-side housing 17, which holds metal terminals 11, and a cable-side housing 18 holding a flat cable 12. When the two housings 17 and 18 are connected together, conductors 14 are connected to the metal terminals 11, respectively. When the conductors 14 are disconnected from the metal terminals 14, the flat cable 12 continues to be held by the cable-side housing 18, and therefore the orderly arrangement of the conductors 14 will not be disturbed, and also the conductors 14 will not be deformed. Therefore, when the conductors 14 are to be again connected to the metal terminals 11, respectively, the conductors 14 do not need to be corrected in shape and arranged properly. In the cable-side housing 18, a holding member 26 is pivotally supported on a positioning member 25, and therefore the excellent operability is obtained when moving the holding member to a holding position.

10 Claims, 6 Drawing Sheets

FLAT CABLE CONNECTOR

BACKGROUND OF THE INVENTION

This invention relates to a connector for a flat cable.

One conventional connector for a flat cable is disclosed in the U.S. Pat. No. 5,871,369 (corresponding to the Unexamined Japanese Patent Application No. Hei 9-55243). As shown in FIG. 8, this connector comprises a housing 100, adapted to be fixed to a circuit board, and metal terminals 101 mounted in the housing 100 so as to be connected to the circuit board. An end portion of a flat cable 102 is adapted to be connected to the housing 100. The flat cable 102 includes a plurality of conductors 103 held in a juxtaposed condition by an insulating sheet 104, and the conductors 103 project from a distal end of the insulating sheet 104 at the end portion of the flat cable.

With respect to means for connecting the flat cable 102 to this flat cable connector, positioning grooves 105, corresponding respectively to the metal terminals 101, are formed in the housing 100, and the exposed conductors 103 of the flat cable 102 are fitted in these positioning grooves 105, respectively, and are applied to the metal terminals 101, respectively, and then these conductors 103 are fixed by a holding bar 106 and a cover 107 in press-contacted relation to the respective metal terminals 101.

In the above flat cable connector, for disconnecting the once-connected flat cable 102, the cover 107 and the holding bar 106 are removed, and then the conductors 103 are disengaged from the positioning grooves 105, respectively. At this time, there is a possibility that the conductors 103 move together with the holding bar 106, and are deformed during the removal of this bar. And besides, in a disconnected condition, the positioning of the conductors 103 is canceled, and therefore the orderly arrangement of these conductors 103 is liable to be disturbed, and also the conductors 103 are liable to be deformed. Therefore, when the flat cable 102 is to be again connected to the flat cable connector, the conductors 103 must be corrected in shape and arranged properly, which has resulted in a problem that the efficiency of the operation is low.

SUMMARY OF THE INVENTION

This invention has been made in view of the above problems, and an object of the invention is to provide a connector in which the efficiency of an operation for again connecting an once-disconnected flat cable to the connector is enhanced.

According to the invention, there is provided a flat cable connector comprising:

a board-side housing, which holds metal terminals and is adapted to be fixed to a circuit board, and a cable-side housing holding a flat cable, the cable-side housing having a plurality of conductors of the flat cable projecting from a distal end of the cable-side housing in a juxtaposed manner, so that the conductors are respectively connected to the terminals, when the board-side housing is fitted with the cable-side housing, wherein the cable-side housing comprises: a positioning member for positioning the conductors, and a holding member pivotally supported on the positioning member so as to be pivotally moved between a holding position and a release position; and in the holding position, the conductors are held between the positioning member and the holding member, and in the release position the holding of the conductors is released.

In the invention, those surfaces of the positioning member and the holding member, which hold the conductors therebetween, are slanting in such a direction that distal ends of the conductors can be directed forwardly in a direction of pivotal movement of the holding member toward the holding position where the holding member holds the conductors.

In the invention, the cable-side housing can be fitted into the board-side housing in a direction of a length of the conductors, and the holding member is disposed forwardly of those portions of the conductors, which are to be contacted respectively with the metal terminals, in the fitting direction, and guide grooves are formed in the holding member, and when the two housings are fitted together, the guide grooves guide the metal terminals respectively to contact positions where the metal terminals contact the conductors, respectively.

When the cable-side housing, holding the flat cable, is attached to the board-side housing, the conductors are connected to the metal terminals, respectively. For disconnecting the conductors from the metal terminals, respectively, the cable-side housing is disengaged from the board-side housing. At this time, the flat cable continues to be held by the cable-side housing, and therefore the orderly arrangement of the conductors will not be disturbed, and also the conductors will not be deformed. Therefore, when the conductors are to be again connected to the metal terminals, respectively, the conductors do not need to be corrected in shape and arranged properly, and therefore the efficiency of the operation is excellent. And besides, the holding member is pivotally supported on the positioning member, and therefore misregistration of the two members with respect to each other will not occur, and therefore the excellent operability is obtained when pivotally moving the holding member to the holding position.

When the conductors 14 are held between the positioning member 25 and the holding member 26, the holding member rubs the conductors in a direction toward their distal ends, and therefore, the conductors will not become loose.

When the two housings are fitted together, the metal terminals are guided by the guide grooves, respectively, and therefore the metal terminals can be positively brought into contact with the conductors, respectively.

Figure 1:
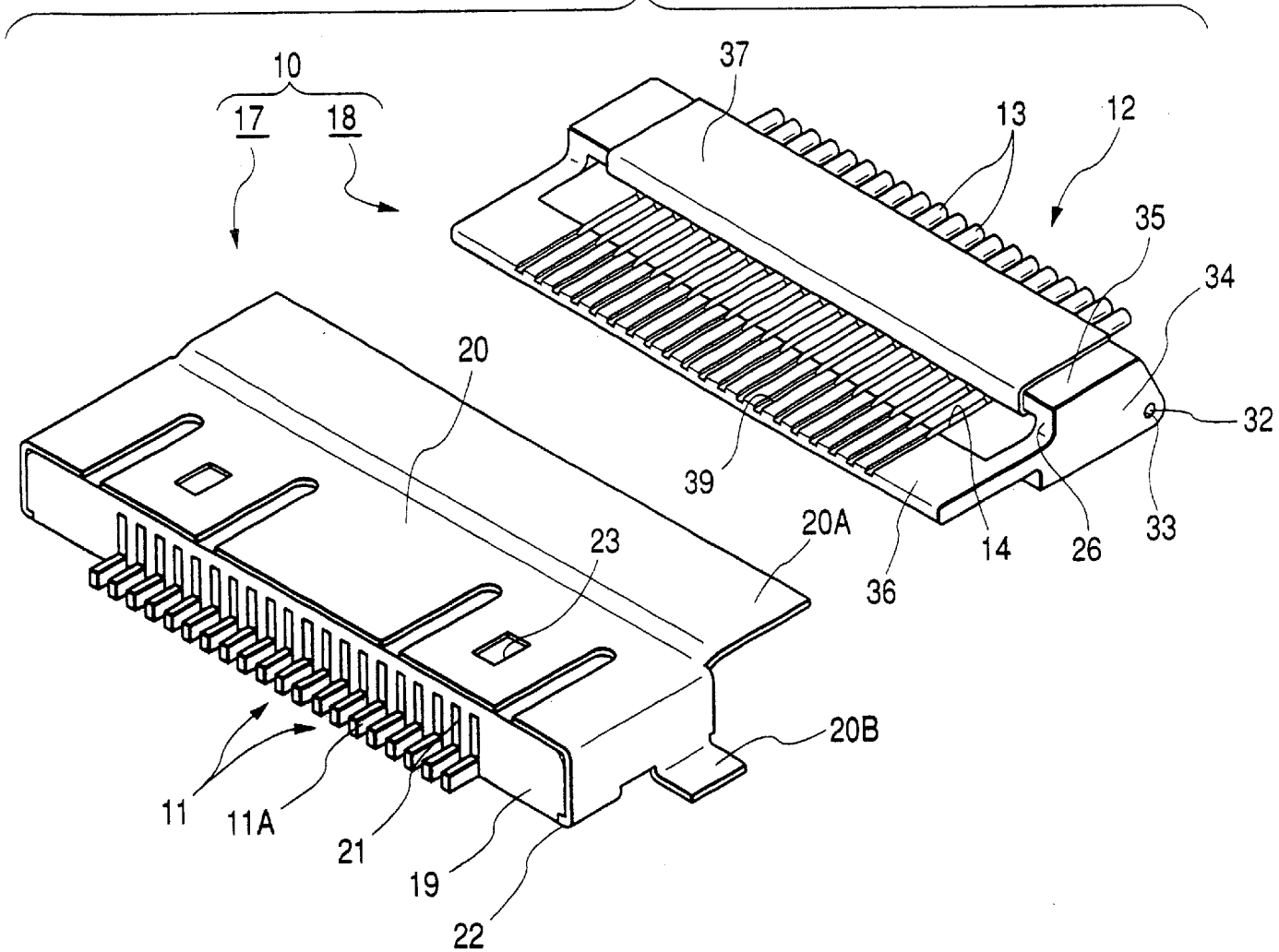
FIG. 1 is a perspective view of a first embodiment, showing a condition in which a cable-side housing is disengaged from a board-side housing.
Figure 2:
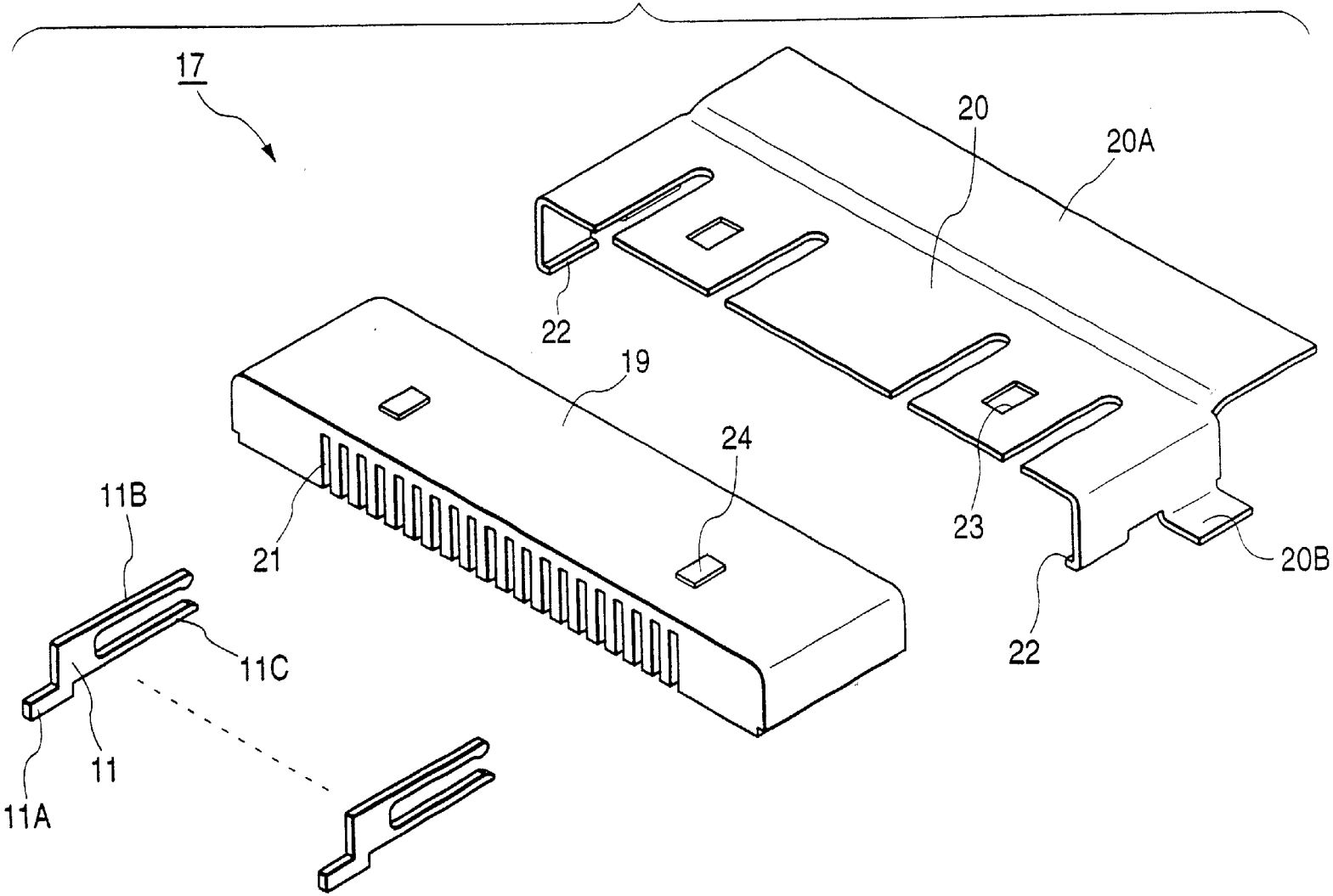
FIG. 2 is an exploded, perspective view of the board-side housing.
Figure 3:
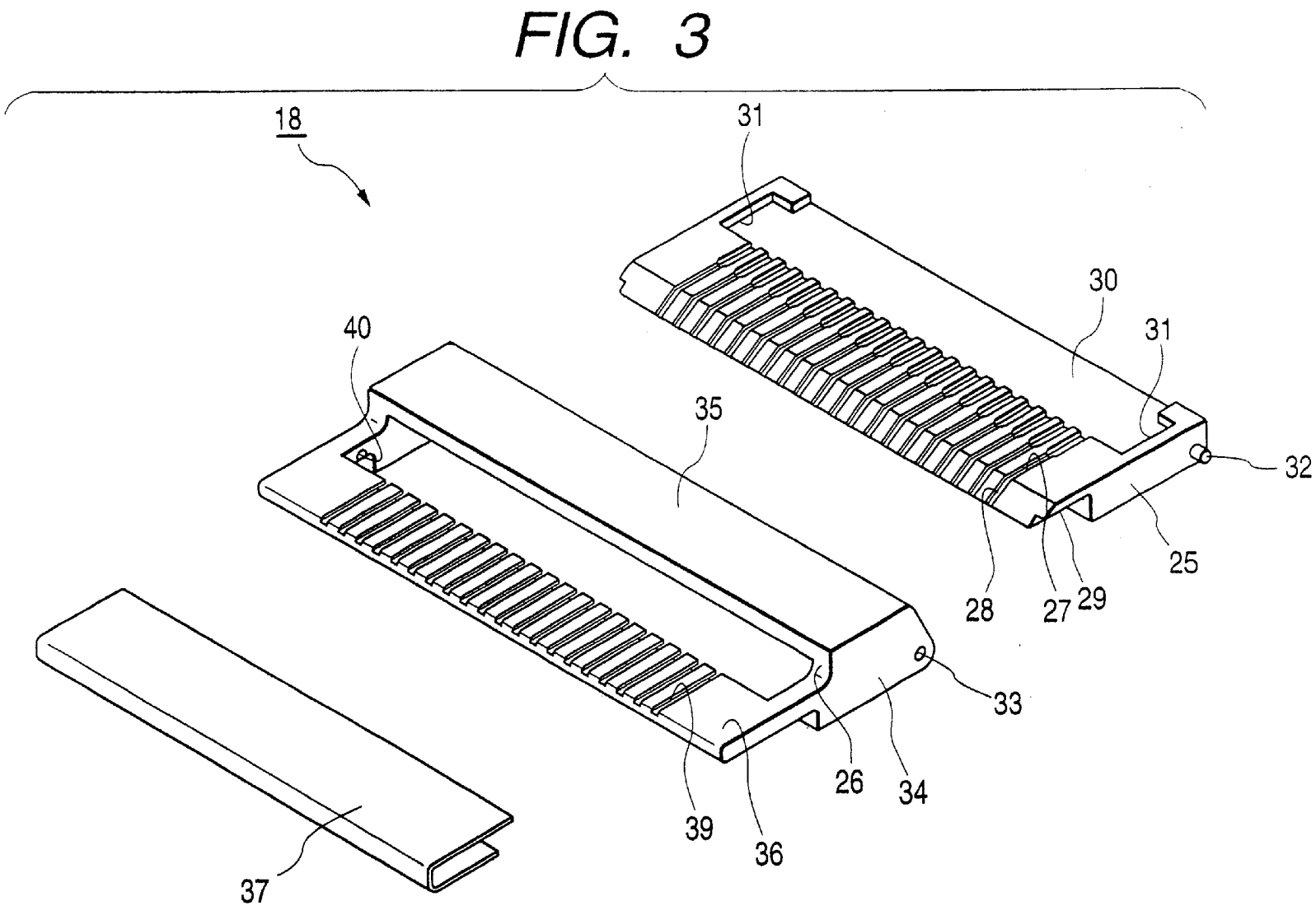
FIG. 3 is an exploded, perspective view of the cable-side housing.

DETAILED DESCRIPTION OF THE PREFERRED EMBODIMENTS (First Embodiment)

A preferred embodiment of the invention will now be described with reference to FIGS. 1 to 7.

A flat cable connector of this invention comprises a housing 10 adapted to be fixed to a circuit board, and metal terminals 11 held in the housing 10 so as to be connected to a circuit on the circuit board. A flat cable 12 is connected to the circuit board through this flat cable connector.

Referring to the flat cable 12, this flat cable 12 includes a plurality of shielded wires 13 fixed in a juxtaposed manner, and conductors 14 of these shielded wires 13 project from a distal end of the flat cable 12 in an exposed condition, and are juxtaposed at a predetermined pitch. The conductors 14 are adapted to be connected to the metal terminals 11, respectively. At that portion of the flat cable adjacent to the exposed conductors 14, shield layers (not shown) of all of the shielded wires 13 are fixed by a plate-like short-circuiting plate 15 in a short-circuited condition. The distal end portions of the conductors 14 are held at the predetermined pitch by an arrangement sheet 16.

The housing 10 comprises a board-side housing 17, which holds the metal terminals 11, and is adapted to be fixed to the circuit board, and a cable-side housing 18 for holding the flat cable 12. The cable-side housing 18 can be fitted into and disengaged from the board-side housing 17, and when the two housings 17 and 18 are fitted together, the conductors 14 are connected to the metal terminals 11, respectively. When the two housings 17 and 18 are disengaged from each other, the conductors 14 are disconnected from the metal terminals 11, respectively.

The board-side housing 17 comprises a housing body 19 of a resin adapted to be fixed to the circuit board, the plurality of metal terminals 11, and a board-side shield cover 20 made of an electrically-conductive material. Slit-like mounting grooves 21 are formed in the housing body 19, and extend from its front surface to its rear surface, and are juxtaposed at a predetermined pitch. The metal terminals 11 are press-fitted in the mounting grooves 21, respectively. The metal terminal 11 includes a mounting portion 11A formed at a rear end thereof, and a pair of upper and lower arm portions 11B and 11C extend forwardly from this mounting portion 11A in a cantilever manner. The conductor 14 of each shielded wire on the cable-side housing 18 is inserted into a space between the upper and lower arm portions 11B and 11C. When the metal terminal 11 is press-fitted into the mounting groove 21, the lower arm portion 11C is held against a lower surface of the mounting groove 21 while a clearance for allowing the upward elastic deformation of the upper arm portion 11B is provided between this upper arm portion 11B and an upper surface of the mounting groove 21. The board-side shield cover 20 is attached to the housing body 19, and in this condition upper and opposite side walls of the shield cover 20 are held in intimate contact with upper and opposite side surfaces of the housing body 19, respectively, and claws 22, formed respectively at lower edges of the opposite side walls of the shield cover 20, are retainingly engaged respectively with edge portions of the housing body 19 at a lower surface thereof, and retaining holes 23, formed through the upper wall of the shield cover 20, are fitted respectively on projections 24 formed on the upper surface of the housing body 19. A connection plate portion 20A extends from the upper wall of the board-side shield cover 20 toward the cable-side housing 18. Earth connection piece portions 20B for connection to a grounding circuit on the circuit board are formed respectively at the lower edges of the opposite side walls of the board-side shield cover 20.

The cable-side housing 18 comprises a positioning member 25 of a resin for positioning the conductors 14, and a holding member 26 of a resin pivotally supported on the positioning member 25 so as to be pivotally moved between a holding position and a release position. In the holding position, the conductors 14 of the flat cable 12 are held between the positioning member 25 and the holding member 26, and in the release position the holding of the conductors 14 is canceled.

The positioning member 25 has a thick plate-like configuration as a whole, and positioning grooves 27 for respectively positioning the conductors 14 are formed in a front half portion of an upper surface of the positioning member 25. The positioning grooves 27 extend in a forward-rearward direction, and the conductor 14 contacts the metal terminal 11 at a rear half portion of each positioning groove 27, and a front half portion of the positioning groove 27 is formed into a holding groove portion 28 which is slanting downwardly forwardly. That portion of the conductor 14, received in this holding groove portion 28, is held between the holding member 26 and the positioning member 25. The holding groove portion 28 is slanting in such a direction that the distal end of the conductor 14 can be directed forwardly in the direction of pivotal movement of the holding member 26 toward the holding position where the holding member 26 holds the conductors 14. The lower surface of the positioning member 25 is recessed at that portion thereof, having the positioning grooves 27 (each including the holding groove portion 28), to provide a stepped portion, thus forming a reduced-thickness portion 29, and this reduced-thickness portion 29 is adapted to be inserted into the space between the two arm portions 11B and 11C of each metal terminal 11 in the board-side housing 17. A placing surface 30, on which the short-circuiting plate 15 of the flat cable 12 is adapted to be placed, is formed on the rear half portion of the upper surface of the positioning member 25, and also retaining portions 31 for preventing the short-circuiting plate 15, placed on the placing surface 30, from moving on this surface 30 is also formed at this rear half portion. A pair of shaft portions 32 are respectively formed on and project from opposite side surfaces of the positioning member 25 at the rear end portion thereof, and the holding member 26 can be pivotally moved about these shaft portions 32.

The holding member 26 of an integrally-molded construction includes a pair of bearing plates 34, each having a bearing hole 33 formed in a rear end portion thereof, an interconnecting plate 35 extending between upper edges of the two bearing plates 34, and a holding plate 36 which is disposed forwardly of the interconnecting plate 35, and extends between the two bearing plates 34. The bearing holes 33 are fitted respectively on the shaft portions 32, so that the holding member 26 is pivotally supported on the positioning member 25. A cable-side shield cover 37, made of an electrically-conductive material, is fitted on the interconnecting plate 35 in such a manner that this shield cover 37 is held in intimate contact with a front edge and upper and lower surfaces of the interconnecting plate 35. A slanting pressing surface 38 is formed at a rear end or edge of the holding plate 36, and this pressing surface 38 is disposed parallel to the holding groove portions 28 when the holding member 26 is located in the holding position, and each conductor 14 is held between this pressing surface 38 and the corresponding holding groove portion 28. A plurality of guide grooves 39 are formed in an upper surface of the holding plate 36, and extend in the forward-rearward direction, and are juxtaposed at the same pitch as that of the positioning grooves 27. When the holding member 26 is located in the holding position, the holding plate 36 is connected to the reduced-thickness portion 29 such that the holding plate 36 and the reduced-thickness portion 29 jointly assume a single plate-like configuration, and in this condition, the guide grooves 39 are disposed respectively in registry with those portions of the conductors 14 to be contacted respectively with the metal terminals 11. Retaining projections 40 are formed respectively on inner surfaces of the bearing plates 34, and these retaining projections 40 are retainingly engaged respectively with lower edges of the opposite side surfaces of the reduced-thickness portion 29, thereby locking the holding member 26 in the holding position relative to the positioning member 25.

Next, the operation of this embodiment will be described.

With respect to the board-side housing 17, the metal terminals 11 are press-fitted into the housing body 19, and the board-side shield cover 20 is attached to the housing body 19, and in this condition the housing body 19 is fixedly secured to the circuit board, and the metal terminals 11 are connected by soldering (not shown) to the circuit on the circuit board, and the earth connection piece portions 20B of the board-side shield cover 20 are connected by soldering (not shown) to an earth circuit on the circuit board.

Figure 4:
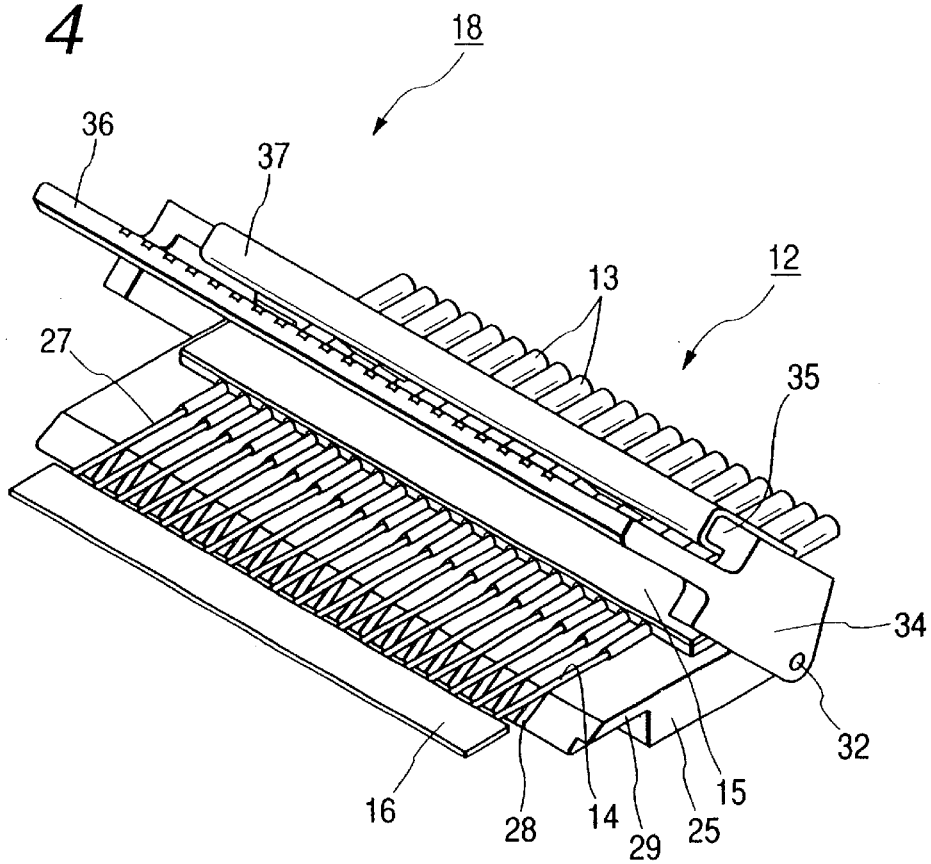
FIG. 4 is a perspective view of the cable-side housing, showing a condition in which a holding member is disposed in a release position.
Figure 5:
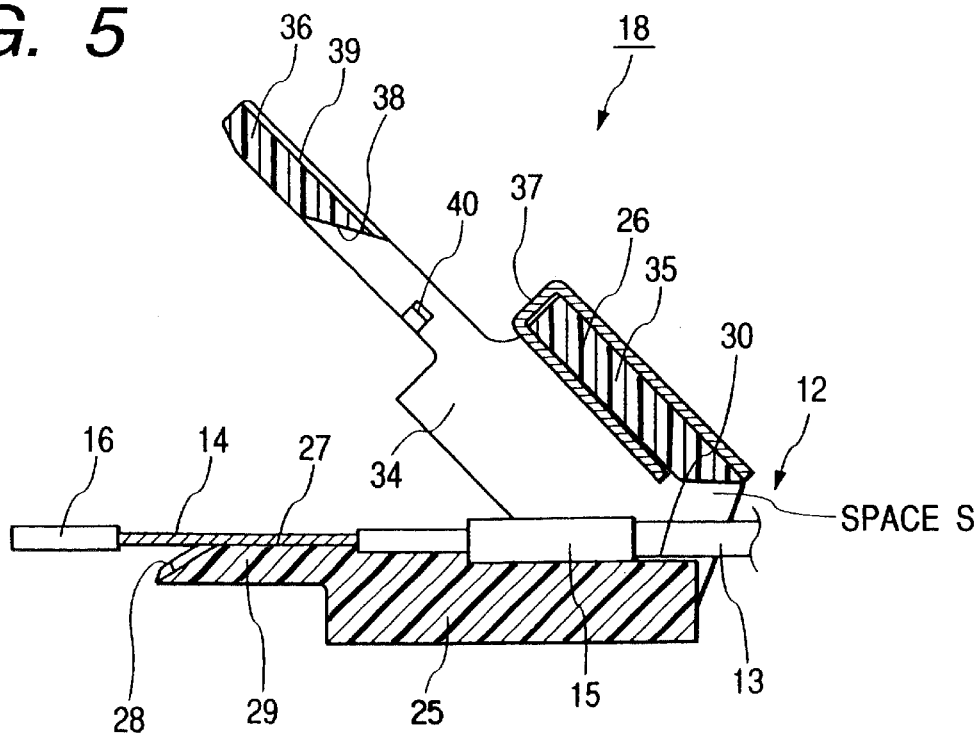
FIG. 5 is a cross-sectional view of the cable-side housing, showing a condition in which the holding member is disposed in a holding position.

With respect to the cable-side housing 18, the holding member 26 is pivotally connected to the positioning member 25, and this holding member 26 is held in an open position, that is, the release position shown in FIGS. 4 and 5. In this condition, the flat cable 12 is placed on the upper surface of the positioning member 25, and the short-circuiting plate 15 is placed on the placing surface 30, and is retained in position by the retaining portions 31, and the conductors 14 are fitted respectively into the positioning grooves 27, thus positioning these conductors 14. In this condition, the holding member 26 is pivotally moved to the holding position, so that the retaining projections 40 are retainingly engaged with the reduced-thickness portion 29, thereby locking the holding member 26 in the holding position. In this condition, the cable-side shield cover 37, fitted on the interconnecting plate 35, is electrically connected to the shield layers (not shown) through the short-circuiting plate 15 of the flat cable 12. In this condition, each conductor 14 is held between the slanting pressing surface 38 of the holding plate 36 and the slanting holding groove portion 28 of the corresponding positioning groove 27 (see FIG. 6). After the conductors 14 are thus held, those portions of the conductors 14, projecting downwardly from the reduced-thickness portion 29 and the holding plate 36, are cut, thereby removing the arrangement sheet 16 from the flat cable 12.

Then, the cable-side housing 18 is fitted into the board-side housing 17. In this fitting operation, the holding plate 36 and the reduced-thickness portion 29 of the cable-side housing 18 are inserted into the space between the upper and lower arm portions 11B and 11C of each metal terminal 11 while the cable-side shield cover 37 slides under the connection plate portion 20A of the board-side shield cover 20. In this fitted condition, the upper arm portion 11B, elastically deformed upwardly, is held in contact with the conductor 14 under a predetermined pressure because of the elastic restoring force thereof, so that the conductor 14 is electrically connected to the circuit on the circuit board. Since the board-side shield cover 20 thus contacts the cable-side shield cover 37, the shield layers (not shown) in the flat cable 12 are electrically connected to the earth circuit on the circuit board, and therefore an electrically-conducting path, defined by the exposed portion of each conductor 14, extending from the shield layer, and the metal terminal 11, is shielded by the two shield covers 20 and 37.

For disconnecting the flat cable 12 from the circuit board, it is only necessary to withdraw the cable-side housing 18 from the board-side housing 17. At this time, the flat cable 12 continues to be held by the cable-side housing 18, and therefore even after the cable-side housing 18 is disconnected from the board-side housing 17, the orderly arrangement of the conductors 14 will not be disturbed, and also the conductors 14 will not be deformed. Therefore, when the flat cable 12 is to be again connected to the circuit board, the conductors 14 do not need to be corrected in shape and arranged properly, and therefore the efficiency of the operation is excellent.

And besides, the holding member 26 is pivotally supported on the positioning member 25, and therefore when moving the holding member 26 from the release position to the holding position, misregistration of the holding member 26 will not occur, and therefore the operability is excellent.

Furthermore, when the holding member 26 is pivotally moved to the holding position so as to hold the conductors 14, the holding member 26 presses the conductors 14, positioned by the positioning member 25, in a direction intersecting the direction of the length of the conductors 14, and therefore the conductors 14 will not be displaced in the direction of the length thereof.

The holding groove portions 28 and the pressing surface 28, which jointly hold the conductors 14, are not disposed perpendicularly to the direction of pivotal movement of the holding member 26, but are slanting relative to this direction, and therefore when the conductors 14 are held between the positioning member 25 and the holding member 26, the pressing surface 38 rubs the conductors 14 in a direction toward their distal ends. Therefore, the conductors 14 will not become loose, and a good condition of contact of the conductors 14 with the respective metal terminals 11 is secured.

The guide grooves 39, formed in the holding member 26, are disposed forwardly of those portions of the conductors 14 to be contacted respectively with the metal terminals 11, and therefore during the time when the two housings 17 and 18 are fitted together, the upper arm portion 11B of each metal terminal 11 slides along the corresponding guide groove 39, and is guided to a predetermined position where the upper arm portion 11*b* contacts the conductor 14. Thus, each metal terminal 11 can be positively brought into contact with the corresponding conductor 14.

The present invention is not to be limited to the embodiment described above and shown in the drawings, and for example the following embodiments falls within the scope of the invention. Various modifications other than the following can also be made without departing from the scope of the invention.

(1) Although the above embodiment is directed to the flat cable connector having the shielding function, the invention can also be applied to a flat cable connector having no shielding function.

Figure 6B:
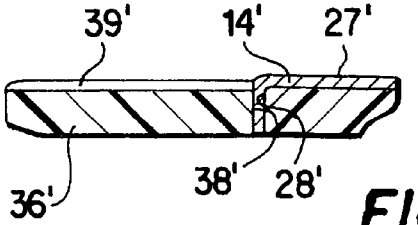
FIG. 6B is a partial cross-sectional view of an alternative embodiment showing the flat cable in a secured condition.
Figure 6A:
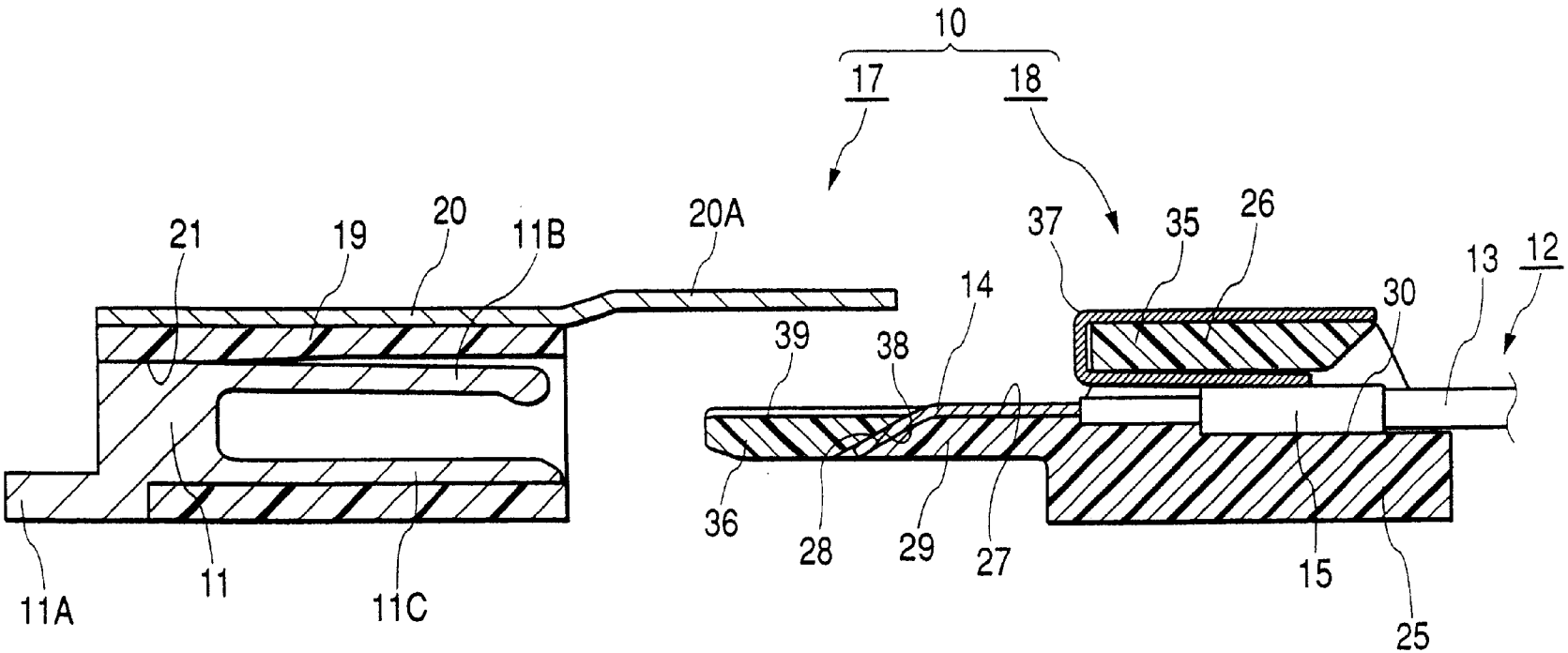
FIG. 6A is a cross-sectional view showing a condition in which the cable-side housing is disengaged from the board-side housing.
Figure 7:
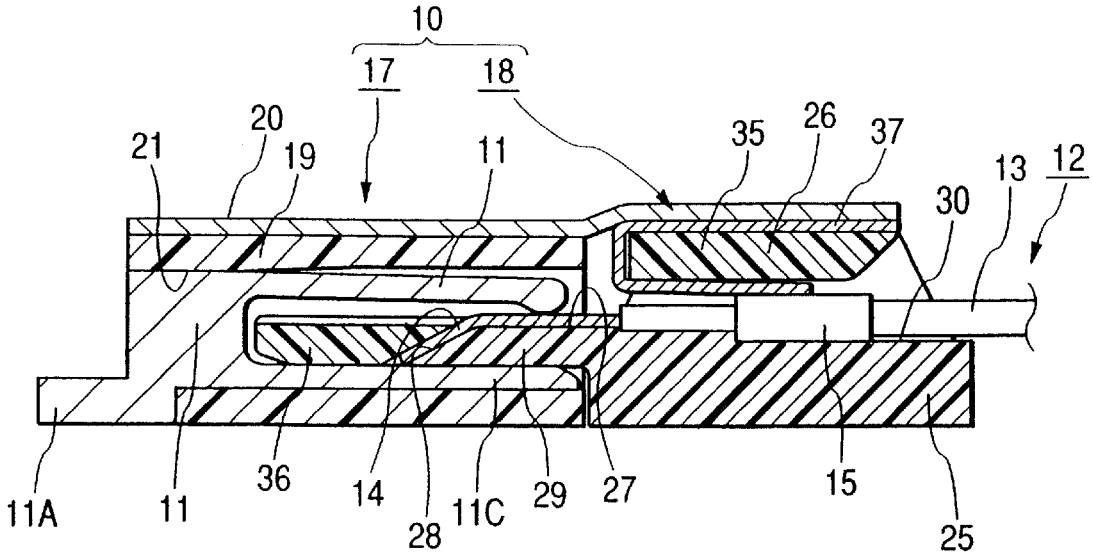
FIG. 7 is a cross-sectional view showing a condition in which the cable-side housing is fitted in the board-side housing.
Figure 8:
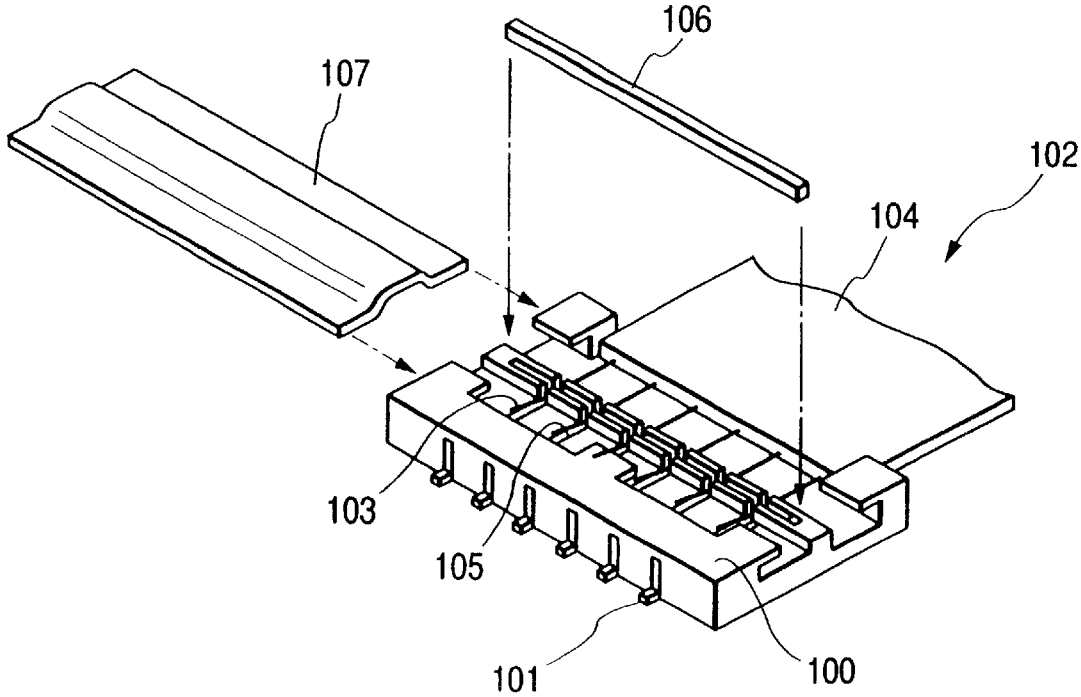
FIG. 8 is a perspective view of a conventional construction.

(2) In the above embodiment, although the conductors are held between the positioning member and the holding member obliquely relative to the direction of pivotal movement of the holding member, the conductors may be held between the two members perpendicularly to the direction of pivotal movement of the holding member. An example of this arrangement is illustrated in FIG. 6B, where features corresponding to those shown in, for example, FIG. 6A are denoted by the same reference numerals including primes attached thereto.

In the above embodiments, in a release position, a space S is formed between the placing surface 30 and the surface of holding member 26 which is opposite to the placing surface 30. Further, the space S is formed at a side of the shaft portion 32. Due to the space S, it is easy to insert the flat cable thereinto.

What is claimed is:

1. A flat cable connector comprising:

a board-side housing, which holds metal terminals and is adapted to be fixed to a circuit board, and a cable-side housing holding a flat cable, said cable-side housing having a plurality of conductors of said flat cable projecting from a distal end of said cable-side housing in a juxtaposed manner, so that said conductors are respectively connected to said terminals, when said board-side housing is fitted with said cable-side housing, said cable-side housing comprising a positioning member for positioning said conductors, and a holding member pivotally supported on said positioning member so as to be pivotally moved between a holding position and a release position;

wherein, in said holding position, said conductors are held between said positioning member and said holding member, and in said release position the holding of said conductors is released, wherein said positioning member and said holding member each include respective surfaces which hold said conductors therebetween, and which slant in such a direction that distal ends of said conductors are directed forwardly in a direction of pivotal movement of said holding member toward said holding position in which said holding member holds said conductors.

2. The flat cable connector according claim 1, wherein said cable-side housing is fitted into said board-side housing in a direction of a length of said conductors, said holding member is disposed forwardly of the portions of said conductors, which are to be contacted respectively with said metal terminals, in the fitting direction, and guide grooves are formed in said holding member, and when said two housings are fitted together, said guide grooves guide said metal terminals respectively to contact positions where said metal terminals contact said conductors, respectively.

3. A flat cable connector comprising:

a board-side housing including a plurality of electrical terminals and adapted to attach to a circuit board; and a cable-side housing engageable with said board-side housing and adapted to hold a flat cable, wherein said cable-side housing comprises:

a cable conductor positioning member including successive first and second surfaces on which conductors of a flat cable are receivable, said second surface extending axially beyond said first surface and being angled relative to said first surface; and a cable conductor holding member pivotably supported on said cable conductor positioning member and movable between a holding position and a release position, said cable conductor holding member including a holding surface, said second surface of said cable conductor positioning member and said holding surface of said cable conductor holding member being arranged in opposition to each other when said cable conductor holding member is in said holding position so as to retain portions of conductors of a flat cable therebetween, and said holding surface being moved away from the second surface to release the flat cable when the cable conductor positioning member is moved to the release position.

4. The connector according to claim 3, wherein said second surface of said cable conductor positioning member is substantially orthogonal to said first surface.

5. The conductor according to claim 3, wherein said first surface of said cable conductor positioning member includes conductor positioning grooves formed therein.

6. The connector according to claim 3, wherein said cable conductor holding member further includes a terminal surface that is substantially coplanar with said first surface of said cable conductor positioning member.

7. The connector according to claim 6, wherein said terminal surface of said cable conductor holding member includes terminal guide grooves therein, each said terminal guide groove being substantially aligned with a respective conductor of a flat cable.

8. The connector according to claim 7, wherein said terminals are guided by said terminal guide grooves when said board-side housing and said cable-side housing are engaged.

9. A flat cable connector comprising:

a board-side housing, which holds metal terminals and is adapted to be fixed to a circuit board, and a cable-side housing holding a flat cable, said cable-side housing having a plurality of conductors of said flat cable projecting from a distal end of said cable-side housing in a juxtaposed manner, so that said conductors are respectively connected to said terminals, when said board-side housing is fitted with said cable-side housing, said cable-side housing comprising a positioning member for positioning said conductors, and a holding member pivotally supported on said positioning member so as to be pivotally moved between a holding position and a release position;

wherein, in said holding position, said conductors are held between said positioning member and said holding member, and in said release position the holding of said conductors is released, wherein said cable-side housing is fitted into said board-side housing in a direction of a length of said conductors, said holding member is disposed forwardly of the portions of said conductors, which are to be contacted respectively with said metal terminals, in the fitting direction, and guide grooves are formed in said holding member, and when said two housings are fitted together, said guide grooves guide said metal terminals respectively to contact positions where said metal terminals contact said conductors, respectively.

10. The flat cable connector according to any one of claim 1, 2, or 9, wherein a space is formed between said positioning member and said holding member, and said flat cable is inserted into the space when said holding member is in said release position.

* * * * *